United States Patent [19]

Nixon

[11] Patent Number: 4,506,616

[45] Date of Patent: Mar. 26, 1985

[54] METHOD FOR FABRICATION OF A QUILT

[76] Inventor: Noma M. Nixon, 13340 Winterhaven, Farmers Branch, Tex. 75234

[21] Appl. No.: 632,683

[22] Filed: Jul. 20, 1984

Related U.S. Application Data

[63] Continuation of Ser. No. 409,033, Aug. 18, 1982, abandoned.

[51] Int. Cl.[3] ..... D05B 1/00

[52] U.S. Cl. ..... 112/262.1

[58] Field of Search ..... 112/262, 265.1, 440, 112/441, 417, 418, 419; 38/102.91; 36/57; 2/274, 266

[56] References Cited

U.S. PATENT DOCUMENTS

| | | | |
|---|---|---|---|
| 362,995 | 3/1887 | Pretty | 139/410 |
| 1,054,233 | 2/1913 | Mueller | 66/195 |
| 1,784,548 | 2/1930 | Seidman | 2/274 |
| 1,950,999 | 3/1934 | Sackner | 112/418 |
| 1,951,000 | 3/1934 | Sackner | 112/418 |
| 2,008,368 | 7/1935 | Sackner | 112/418 X |
| 2,008,607 | 7/1935 | Chatterton | 112/417 |

*Primary Examiner*—Ronald Feldbaum

[57] ABSTRACT

A method and apparatus is described for fabricating a quilt produced from a quilt assembly comprising top and bottom linings (12, 16) on either side of a batt (14). A first roller (18) is connected to a first edge of the assembly (10). A second roller (26) is connected to a second edge of the assembly (10) opposite the first roller (18). The rollers (18, 26) are rolled toward each other to produce first and second rolls (28, 40) each comprising a portion of the assembly (10). Between the rolls (28, 40) there is left an unrolled portion of the assembly (10). Holders (30, 42) are connected respectively between the rolls (28, 40) and the nonrolled portion of the assembly (10). The assembly (10) is then passed through a sewing machine (44) to sew together the linings (12, 16) and the batt (14) in the unrolled portion of the assembly (10). The holder (42) is then removed to permit the sewing of the portion of assembly (10) within the second roll (40). Next, the holder (30) is removed to permit the sewing of the portion of the assembly (10) within the first roll (28). This completes the basic assembly of a quilt in accordance with the method of the present invention. The apparatus of the present invention comprises the rollers (18, 26) and the holders (30, 42).

9 Claims, 10 Drawing Figures

FIG. 9
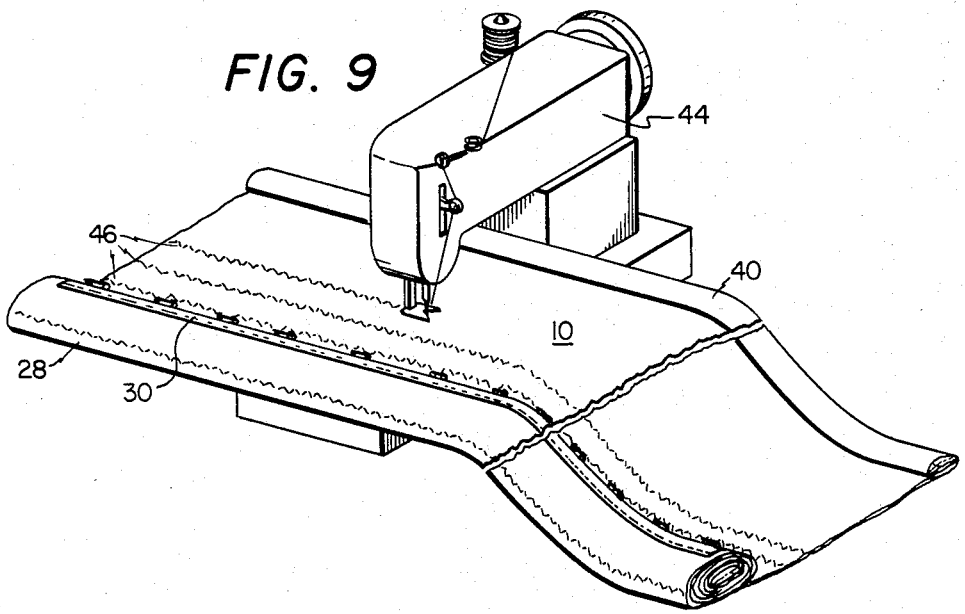
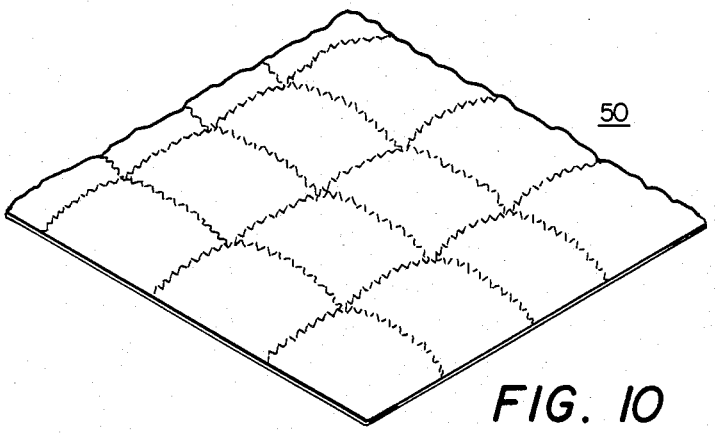
FIG. 10

METHOD FOR FABRICATION OF A QUILT

This application is a continuation of application Ser. No. 409,033, filed Aug. 18, 1982, now abandoned.

TECHNICAL FIELD

The present application pertains to the manufacture of fabric products and in particular to the fabrication of a quilt.

BACKGROUND ART

Individuals have been producing quilts by hand for hundreds of years and have continued to use the same basic assembly process with the modern sewing machine. Quilts typically have at least three layers and require many yards of sewing through thick fabric. Thus, for an individual to produce a quilt, even with modern equipment, there is still a great deal of time and effort required.

Since there is an extensive demand for home-made quilts, both for personal use and sale, there exists a need for an improved method and inexpensive apparatus to assist an individual in the fabrication of a high quality quilt.

SUMMARY OF THE INVENTION

A representative embodiment of the present invention comprises a method for fabricating a quilt having a top lining, a bottom lining and a batt. A first step comprises placing the batt between the top lining and the bottom lining to form an assembly. The next step comprises joining together the corresponding edges of the batt and the linings along a first edge of the assembly. The next step comprises joining together the corresponding edges of the batt and the linings along the second edge of the assembly wherein the second edge of the assembly is opposite the first edge of the assembly. A portion of the assembly is rolled starting at the first edge to form a first roll. A portion of the assembly is rolled starting at the second edge to produce a second roll leaving a non-rolled portion of the assembly between the rolls. The first roll is removably attached to the non-rolled portion of the assembly and the second roll is also removably attached to the nonrolled portion of the assembly. The next step comprises sewing along the non-rolled portion of the assembly to join together the linings and the batt. The first roll is then detached from the nonrolled portion of the assembly. The next step comprises sewing along the portion of the assembly previously in the first roll to join together the linings and the batt. Next, the second roll is detached from the nonrolled portion of the assembly. And finally, the last step comprises sewing along the portion of the assembly previously in the second roll to join together the linings and the batt, thereby completing production of the quilt.

BRIEF DESCRIPTION OF THE DRAWINGS

For a more complete understanding of the present invention and the advantages thereof, reference is now made to the following description taken in conjunction with the accompanying Drawings in which:

FIG. 9 is an illustration of the sewing of the quilt assembly along a portion thereof which was previously included in one of the rolls, and FIG. 10 is an illustration of a completed quilt utilizing the technique of the present invention and further including the addition of transverse stitching to produce a rectangular pattern quilt.

DETAILED DESCRIPTION

Figure 1:
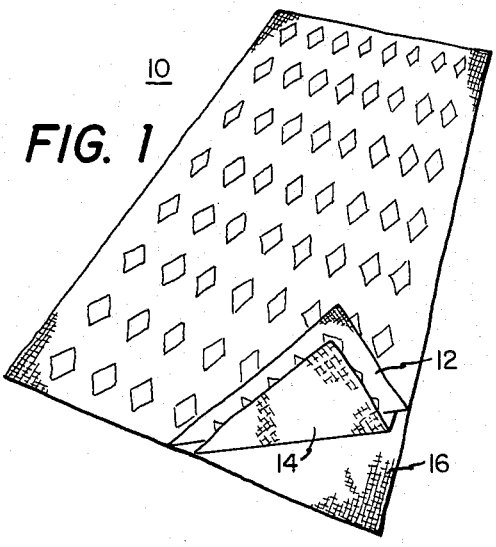
FIG. 1 is a perspective view of the quilt assembly showing a batt between top and bottom linings.

Referring now to FIG. 1 there is illustrated a quilt assembly 10 comprising a top lining 12, a batt 14 and a bottom lining 16. The linings and batt are essentially the same size and are aligned in a stack to form the assembly 10. Fabrication is made easier if the linings have similar texture and pliability.

Figure 2:
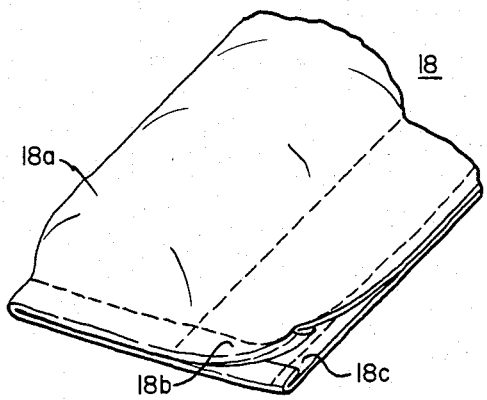
FIG. 2 is a perspective view of a roller for use in the fabrication technique of the present invention.

Referring now to FIG. 2 there is illustrated a roller 18 which essentially comprises one rectangular fabric member which is folded once about the longitudinal axis and then sewn along the double layer center line. A strip of padding is enclosed in the roller between the fold line and the stitch line. As shown in FIG. 2, the roller 18 comprises a padded body **18*a*, a first flap 18*b* and a second flap 18*c***.

Figure 3:
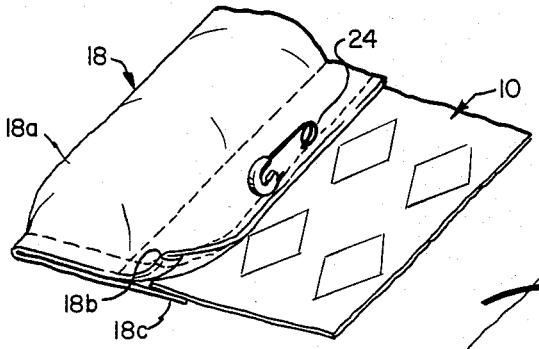
FIG. 3 is a perspective view illustrating the attachment of the roller to the quilt assembly.

Referring now to FIG. 3 there is illustrated the attachment of the roller 18 to the quilt assembly 10. A first edge of the quilt assembly is inserted between the flaps **18*b* and 18*c*. A plurality of safety pins, such as 24, are connected through the flaps 18*b* and 18*c* and through the quilt assembly 10 for joining the roller 18 to the edge of the quilt assembly 10**.

Figure 4:
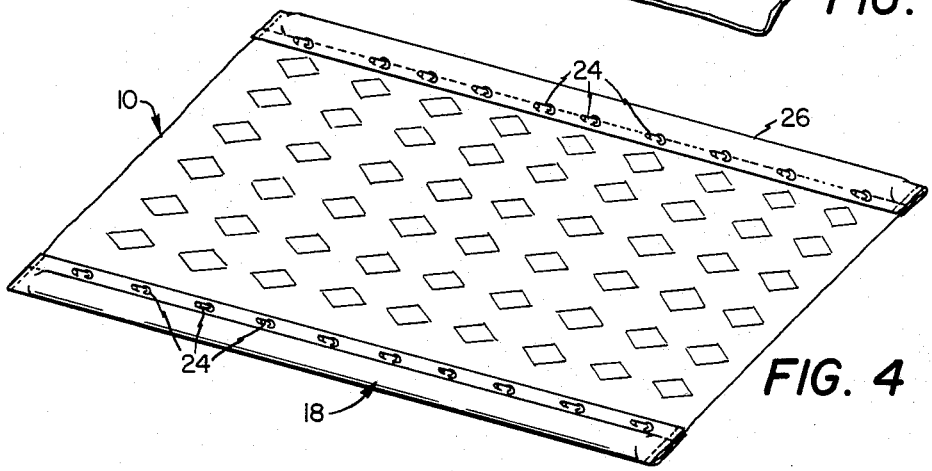
FIG. 4 is a perspective view showing the quilt assembly with rollers connected to opposite edges thereof.

Referring now to FIG. 4 there is shown the roller 18 connected to a first edge of the quilt assembly 10. A second roller 26 is connected to a second edge of the assembly 10 where the second edge is opposite from the first edge.

Figure 5:
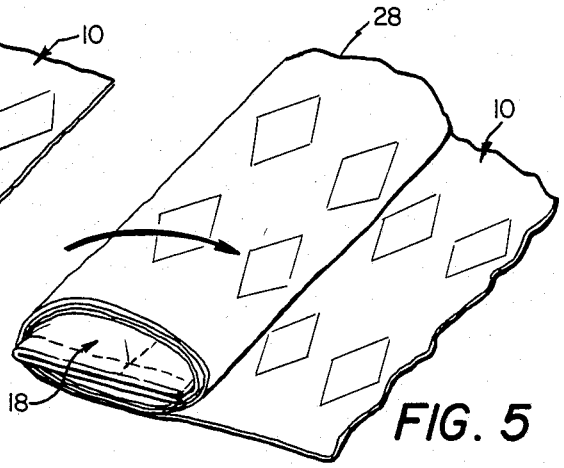
FIG. 5 is a perspective view illustrating the rolling of a portion of the quilt assembly having a roller therein to produce a first roll.

Referring now to FIG. 5 there is illustrated the roller 18 as it is rolled about the first edge of the quilt assembly 10 to produce a first roll 28 comprising a portion of the assembly 10.

Figure 6:
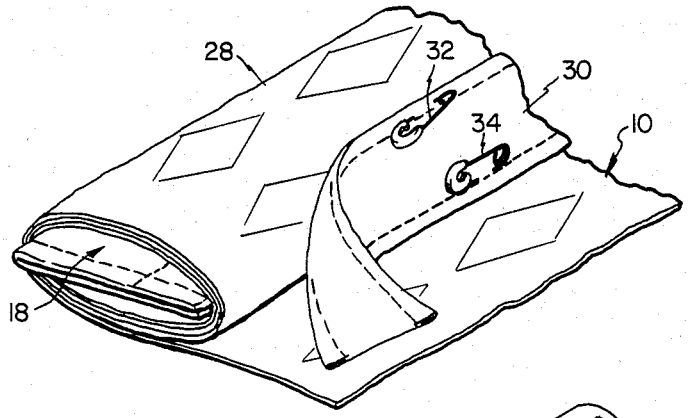
FIG. 6 is a perspective view illustrating the attachment of the first roll shown in FIG. 5 to a nonrolled portion of the quilt assembly by use of a holder.

Referring now to FIG. 6 there is illustrated the roller 18 within the roll 28 of the quilt assembly 10. A first holder 30, comprising an elongate fabric strip, is joined by a plurality of safety pins, illustrated as 32 and 34, to both the roll 28 and the nonrolled portion of the quilt assembly 10.

Figure 7:
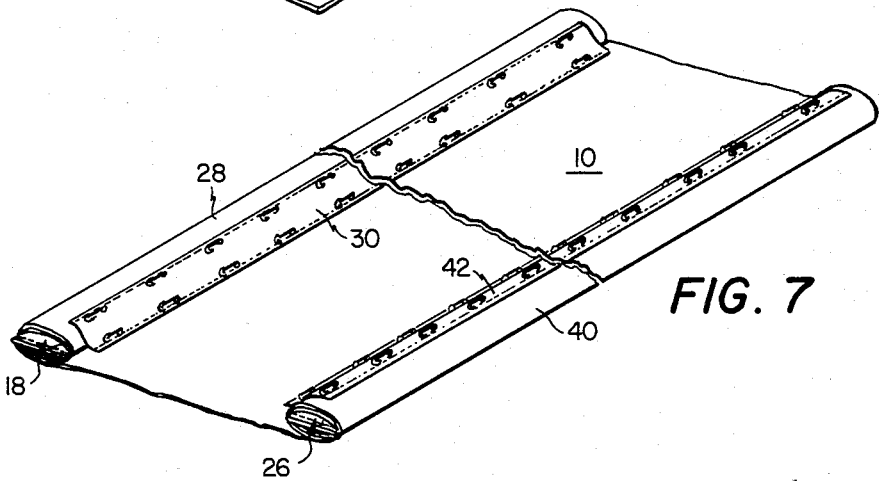
FIG. 7 is a perspective view illustrating the connection of first and second holders to first and second rolls of the quilt assembly leaving a nonrolled portion of the quilt assembly therebetween.

Referring now to FIG. 7 there is illustrated the roll 28 connected by holder 30 to the nonrolled portion of the quilt assembly 10. A second roll 40 is connected by a second holder 42 to the nonrolled portion of the quilt assembly 10.

Figure 8:
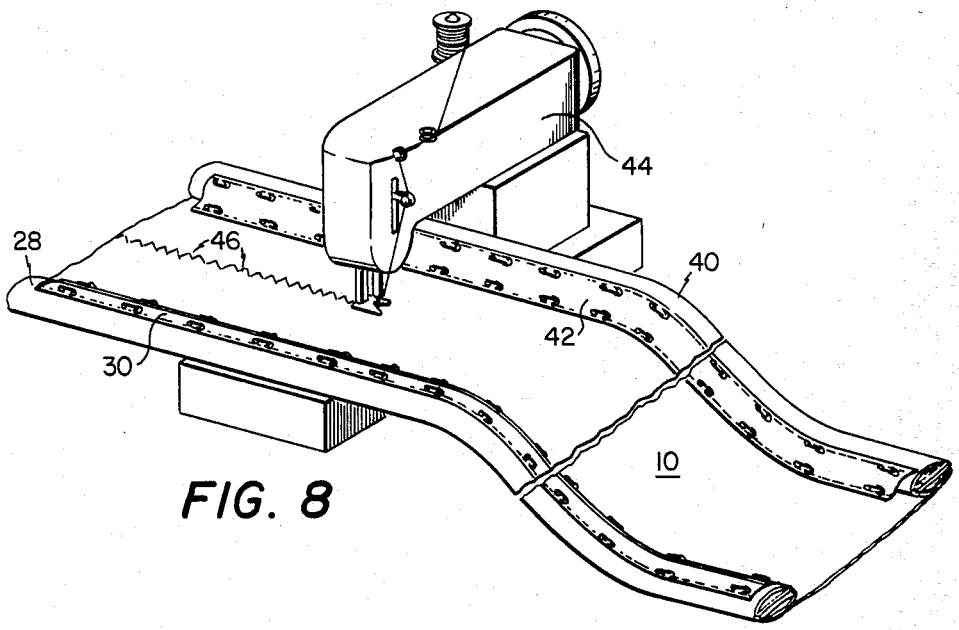
FIG. 8 is an illustration of the sewing of the quilt assembly along the nonrolled portion thereof by use of a conventional sewing machine.

Referring now to FIG. 8 there is shown the quilt assembly 10 comprising first and second rolls 28 and 40 separated by the nonrolled portion of the quilt assembly 10. The nonrolled portion is preferably about 15 inches wide. The quilt assembly 10 is fed into a sewing machine 44 to produce a stitch 46 longitudinally along the nonrolled portion of the assembly 10. The operator feeds the rolls 28 and 40 into the machine 44 to produce the stitch 46 which joins together the top and bottom linings 12 and 16 to the batt 14. The sewing is completed for the length of the assembly 10. The sewing machine 44 is, for example, a Singer Touch and Sew II, Model 778. A selected stitch pattern for this machine is Feather Stitch No. 51 Flexi Stitch. The stitch width is set to its widest setting (5). The stitch control is set to 8 for medium weight material and to 9 or 10 for lighter weight material.

After the stitch 46 is completed, additional parallel stitches are completed in the nonrolled portion of the quilt assembly 10. The stitches are preferably about 1½ inches apart.

A convenient method to maintain parallel stitching is to clamp a length of wire to the shank of the pressure foot of the sewing machine. The wire is bent to extend about 1½ inches outward and downward from the pressure foot. After the first stitch, later stitches can be guided by aligning the extended wire with a previous stitch. The wire is rotated 180 degrees to stitch on the opposite side of the pressure foot.

Referring to FIG. 9 there is illustrated the next step of the stitching operation. The holder 42 (shown in FIG. 8) is removed to open up the portion of the quilt assembly 10 within the roll 40. This produces a new open area for stitching. As described above, the quilt assembly 10 is fed into the sewing machine 44 to produce a stitch along the length of the assembly 10 within the area of the assembly which was previously in the roll 40. It may be helpful to temporarily pin down the remaining portion of roll 40 after it has been partially unrolled. After the portion of the quilt assembly 10 within roll 40 has been sewn, the roll 40 is reestablished and an opening is produced by unrolling the roll 28. This new open area of the quilt assembly 10 is then fed into the machine 44 in the manner described above to stitch the portion of the quilt assembly 10 which was previously within the roll 28. After this portion has been sewn, the basic stitching required to produce a quilt has been completed.

Should an additional pattern be desired for the quilt, there is shown in FIG. 10 a resulting quilt 50 wherein the quilt is provided with additional stitches which are transverse to the stitches which were produced in the method described above. This produces an arrangement of square rectangular padded sections for the quilt.

The method of the present invention is now described in reference to the FIGURES. The batt 14 is positioned between the linings 12 and 16 to form the assembly 10. The first edge of the assembly 10 is joined together by the first roller 18. This joins together corresponding edges of the linings 12 and 16 and batt 14. The second roller 26 is likewise connected to the second edge of the assembly 10. The rollers 18 and 26 are next rolled toward each other to form rolls 28 and 40 (FIG. 7) with each roll comprising a portion of the assembly 10. The rolls are on either side of an unrolled portion of the assembly 10. The roll 28 is joined to the unrolled portion of the assembly 10 by a holder 30. The roll 40 is joined to the unrolled portion of the assembly 10 by a holder 42. The assembly 10 is then fed into the sewing machine 44 to apply a stitch along the unrolled portion of the assembly 10. This joins together the linings 12 and 16 with the batt 14.

After the nonrolled portion of the assembly 10 has been sewn together, the holder 42 is removed and a part of the roll 40 is unrolled to expose a new area. The new area of the assembly 10 is then likewise fed through the sewing machine 44 to stitch together the linings 12 and 16 with the batt 14. After all of the material in the roll 40 has been sewn together, the roll 40 is temporarily reestablished and the roll 28 is unrolled to expose a new area. The portion of the assembly 10 within the roll 28 is then sewn in a similar manner by passing it through the sewing machine 44. This completes fabrication of the quilt which comprises the assembly 10. If further quilting effect is desired, the assembly 10 can be passed through the machine 44 again for additional stitches which are transverse to the initial stitching described above.

In summary, the present invention comprises a method and apparatus for the fabrication of the quilt through the efforts of an individual using a conventional sewing machine. This method substantially reduces the time required to produce a quilt as compared to conventional techniques. Further, the tight holding of the rolls prevents the multiple layers of the quilt from sliding relative to each other thereby preventing the quilt from "puckering".

I claim:

1. A method for fabricating a quilt having a top lining, a bottom lining and a batt, the method comprising the steps of:

placing said batt between said top lining and said bottom lining to form an assembly, joining together the corresponding edges of said batt and said linings along a first edge of said assembly;

joining together the corresponding edges of said batt and said linings along a second edge of said assembly;

rolling a portion of said assembly starting at said first edge of said assembly to form a first roll, rolling a portion of said assembly starting at said second edge of said assembly to form a second roll leaving a nonrolled portion of said assembly between said rolls, removably attaching said first roll to said unrolled portion of said assembly, removably attaching said second roll to said nonrolled portion of said assembly, sewing along said unrolled portion of said assembly to join together said linings and said batt, detaching said first roll from said unrolled portion of said assembly, sewing along the portion of said assembly previously in said first roll to join together said linings and said batt, detaching said second roll from said unrolled portion of said assembly, and sewing along the portion of said assembly previously in said second roll to join together said linings and said batt, thereby producing said quilt.

2. A method as recited in claim 1 wherein the steps of joining together the corresponding edges of said batt and said linings each comprises pinning the corresponding edges of said batt and said linings between elongate fabric flaps which are joined to a padded elongate body.

3. A method as recited in claim 1 wherein the steps of removably attaching said first and said second rolls to said unrolled portion of said assembly comprises pinning a first elongate fabric strip along a first edge thereof to said first roll and along a second edge thereof to said unrolled portion of said assembly and pinning a second fabric strip along a first edge thereof to said second roll and along a second edge thereof to said unrolled portion of said assembly.

4. A method for fabricating a quilt, comprising the steps of:

arranging a plurality of layers of fabric for form an assembly having a first edge, inserting said first edge between a pair of elongate flaps each of which has a longitudinal edge thereof joined lengthwise to a padded body, removably joining said flaps to a part of said assembly between said flaps, rolling at least a portion of said assembly about said padded body, and joining said layers of fabric together.

5. The method recited in claim 4 further including the steps of:

inserting a second edge of said assembly between a second pair of elongate flaps each of which has a longitudinal edge thereof joined lengthwise to a second padded body, removably joining said second pair of flaps to a part of said assembly between said second pair of flaps, and rolling at least a portion of said assembly about said second padded body.

6. The method recited in claim 4 further including a step or disconnecting said flaps from said assembly.

7. A method for fabricating a quilt comprising the steps of:

arranging a plurality of layers of fabric to form an assembly having a first edge, inserting said first edge between first and second longitudinal segments of an elongate fabric member which is folded along a longitudinal line to enclose an elongate padded body, removably joining said longitudinal segments to a part of said assembly between said longitudinal segments, rolling at least a portion of said assembly about said padded body, and joining said layers of fabric together.

8. The method recited in claim 7 further including the steps of:

inserting a second edge of said assembly between third and fourth longitudinal segments of a second elongate fabric member which is folded about a longitudinal line to enclose a second elongate padded body, removably joining said third and fourth longitudinal segments to a part of said assembly between said third and fourth longitudinal segments, and rolling at least a portion of said assembly about said second padded body.

9. The method recited in claim 7 further including a step of disconnecting said longitudinal segments from said assembly.

* * * * *